United States Patent [19]

Vanhoutte

[11] Patent Number: 4,602,749

[45] Date of Patent: Jul. 29, 1986

[54] DEVICE FOR WINDING A FABRIC DURING THE DIFFERENT PHASES OF ITS MANUFACTURE

[75] Inventor: Jacques H. Vanhoutte, Le Grand Lemps, France

[73] Assignee: Valisere S.A., Grenoble, France

[21] Appl. No.: 692,989

[22] Filed: Jan. 22, 1985

[30] Foreign Application Priority Data

Feb. 10, 1984 [FR] France ..... 84 02480

[51] Int. Cl.[4] ..... B65H 18/16

[52] U.S. Cl. ..... 242/66

[58] Field of Search ..... 242/65, 66, 67.1 R; 139/304, 307, 308, 313

[56] References Cited

U.S. PATENT DOCUMENTS

| | | | |
|---|---|---|---|
| 2,881,983 | 4/1959 | Jurgensen et al. | 242/65 |
| 4,139,166 | 2/1979 | Powell et al. | 242/66 |
| 4,252,154 | 2/1981 | Alexander | 139/304 |

FOREIGN PATENT DOCUMENTS

| | | | |
|---|---|---|---|
| 245093 | 7/1910 | Fed. Rep. of Germany . | |
| 705804 | 11/1930 | France . | |
| 1040480 | 10/1953 | France . | |
| 1126272 | 11/1956 | France . | |
| 0148140 | 9/1983 | Japan | 242/66 |

*Primary Examiner*—John M. Jillions

*Attorney, Agent, or Firm*—Parkhurst & Oliff

[57] ABSTRACT

The present invention relates to a device for winding a fabric, during the different phases of its manufacture, on a support mandrel driven by tangential contact with driving cylinders. In this device, the driving cylinders are at least two in number and are disposed above a winding, symmetrically on either side of a vertical plane passing through the axis of said winding, these cylinders exerting a constant pressure on the winding and moving on a guiding element as the diameter increases. The invention is more particularly applicable to the winding of knitted fabric as it leaves a knitting machine.

10 Claims, 5 Drawing Figures

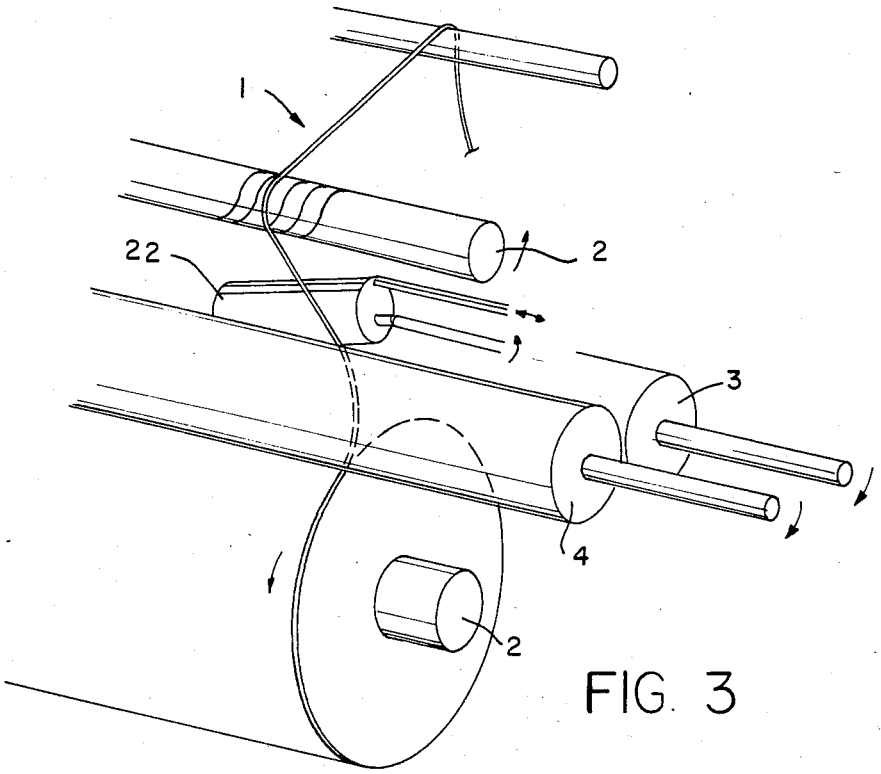
FIG. 3
FIG. 5
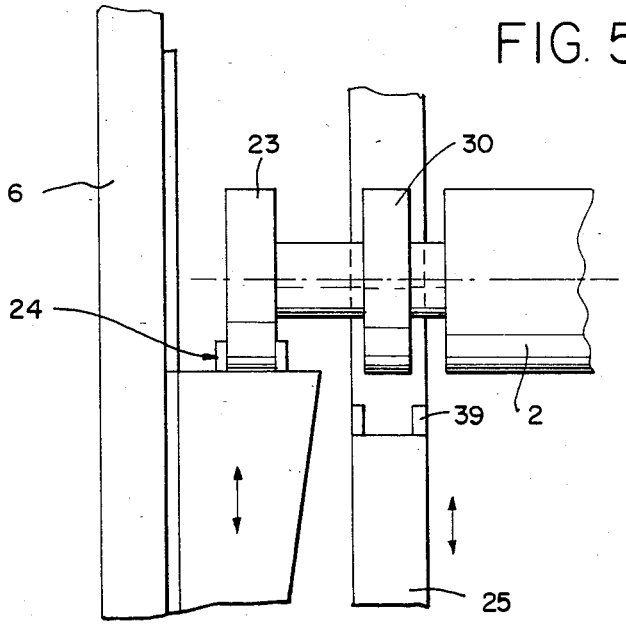

DEVICE FOR WINDING A FABRIC DURING THE DIFFERENT PHASES OF ITS MANUFACTURE

BACKGROUND AND SUMMARY OF THE INVENTION

The present invention relates to an improvement in devices for winding a fabric (woven, knitted . . . fabric) on an appropriate support mandrel during the different phases of manufacture of said fabric (weaving, knitting, dyeing, finishing, . . . ).

It relates more particularly to a winder device adaptable on warp knitting machines (Raschel knitting machines), but it is obvious that this is not limiting and that it may be used in other domains where similar problems are raised, for example on weaving looms.

Up to the present time, the winding of the knit as it leaves the machine poses numerous problems, being given that it is necessary to maintain the knit under constant tension if it is desired to avoid defects and that it is sought more and more to form rolls of knit of large diameter in order to reduce stops in production and to obtain cuts of considerable length.

In general, the knit produced is wound on a tubular support or mandrel which facilitates subsequent manipulations.

Up to the present time, two techniques are employed for winding the knit as it leaves the machine.

The first of these techniques consists in having an axial drive of the support mandrel, the speed of drive of said mandrel being modified as the diameter of the winding increases so as to have a constant linear speed and a likewise constant tension.

The second consists in effecting the drive by means of two bearing rollers on which rests the wind of knitted fabric (carrying tangential winding).

In both cases, numerous problems are raised when it is desired to obtain large-diameter windings, these problems being further accentuated when the knit made is an elastic knit.

In fact, in both cases, the two factors: traction and pressure, may produce surface defects in the knit.

Moreover, the traction does not allow a sufficient relaxation of the elastic knits, hence the necessity of effecting a tensionless winding which generally poses the problem of the correct unwinding of the selvedges.

Furthermore, in the case of tangential winding, the pressure or crushing due to the increase in the weight of the piece, particularly when it is desired to have windings weighing more than one hundred kilos, does not make it possible to have a relaxation of the knit already wound.

Finally, in both cases, the removal of the roll formed as well as the positioning of the support mandrel requires manipulations which are all the more delicate to carry out as the piece is heavy.

U.S. Pat. No. 4,139,166 also discloses a device for winding a fabric in which the material is wound on a support mandrel, the drive being obtained by tangential contact with driving cylinders disposed above the winding. According to the solution described in that Patent, the driving cylinders are maintained under pressure against the fabric and are driven at different speeds, this in order to obtain a very close winding. Such an installation can therefore not be used when it is desired to wind fragile materials such as knits, being given that, in that case, defects would be produced on this material, in particular watering effects. Furthermore, the system for communicating the pressure to the driving cylinders is essentially constituted by an articulated arm associated with a jack which, on the one hand, therefore necessarily limits the diameter of the winding capable of being formed and, on the other hand, considerably increases the ground surface of the installation.

The device according to the invention overcomes the drawbacks of the prior known solutions and in particular makes it possible to produce a winding which is independent of the weight of the piece, to considerably increase the diameter (therefore the weight) of the winding formed as well as to facilitate positioning and removal of the roll of material formed. Moreover, the device according to the invention makes it possible to avoid creating surface defects on the material and to effect a tensionless winding, particularly in the case of elastic knits, and this whilst having a correct unwinding of the selvedges.

The invention therefore generally relates to a device for winding a fabric (in particular a knitted fabric) during the different phases of its manufacture, device whereby the material is wound on a support mandrel, drive being obtained by tangential contact with driving cylinders disposed above the winding, the device according to the invention being characterized in that the driving cylinders are at least two in number and are disposed symmetrically on either side of a vertical plane passing through the axis of said winding, these cylinders rotating at the same speed, exerting a constant pressure on the winding and being mounted on a support capable of sliding along vertical uprights, disposed on each side of the machine, and this as the diameter increases.

In a preferred embodiment of the invention, the material is wound on a mandrel supported by a carriage (or container) adapted to serve for transport and for storage.

Furthermore, the winder according to the invention may be adapted either at the front or at the rear of the machine. The driving cylinders may be driven by an independent motor or directly from the machine. In the former case, the speed may be adjusted by means of a potentiometer or a reduction gear and, in the latter, by a gear box. The winder is, of course, disengageable with respect to the machine.

The device according to the invention is associated with means for modifying the pressure exerted by the driving cylinders on the winding.

Furthermore, the device according to the invention also comprises an element for ensuring unwinding of the selvedges, this element being, in one embodiment, constituted by an assembly comprising a rotating brush and an expander bar.

BRIEF DESCRIPTION OF THE DRAWINGS

The invention will be more readily understood on reading the following description with reference to the accompanying drawings, in which:

FIG. 3 is a partial view in perspective showing a selvedge unwinder-expander.

FIG. 5 is a view of the winding mandrel in winding position.

DETAILED DESCRIPTION OF THE PREFERRED EMBODIMENTS

Figure 1:
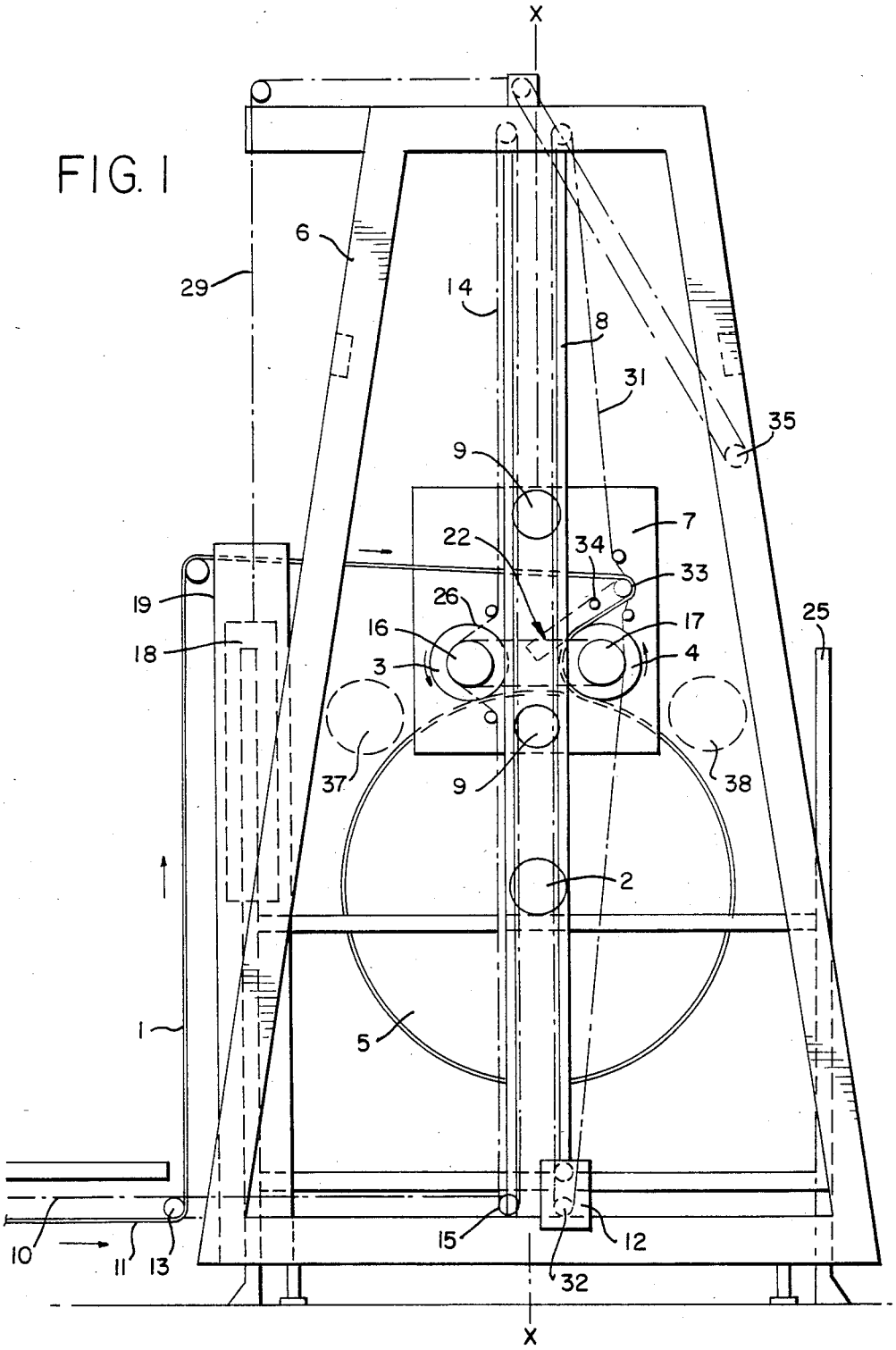
FIGS. 1 and 2 are end and elevation views, respectively, of a winder device according to the invention.
Figure 2:
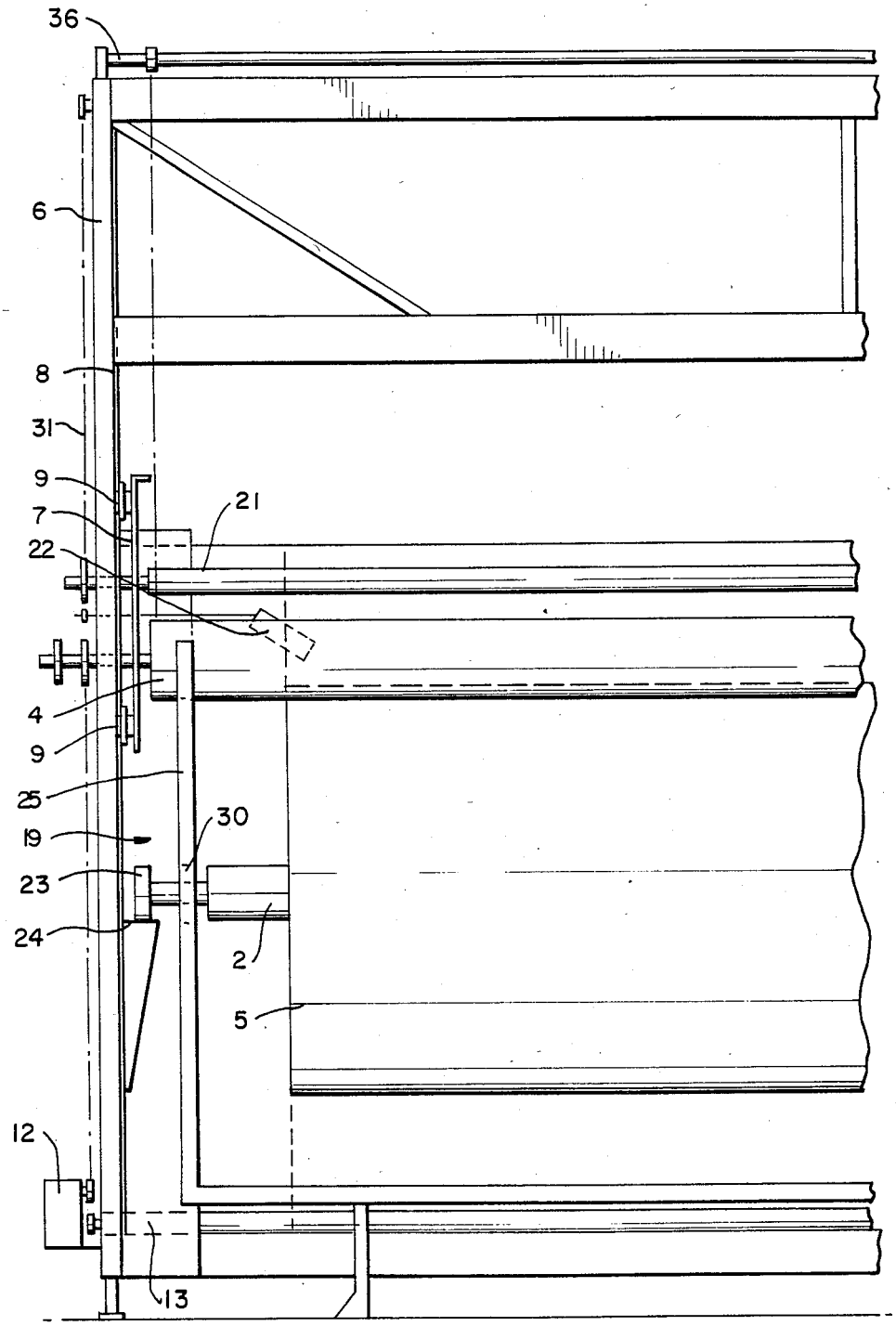
Figure 4:
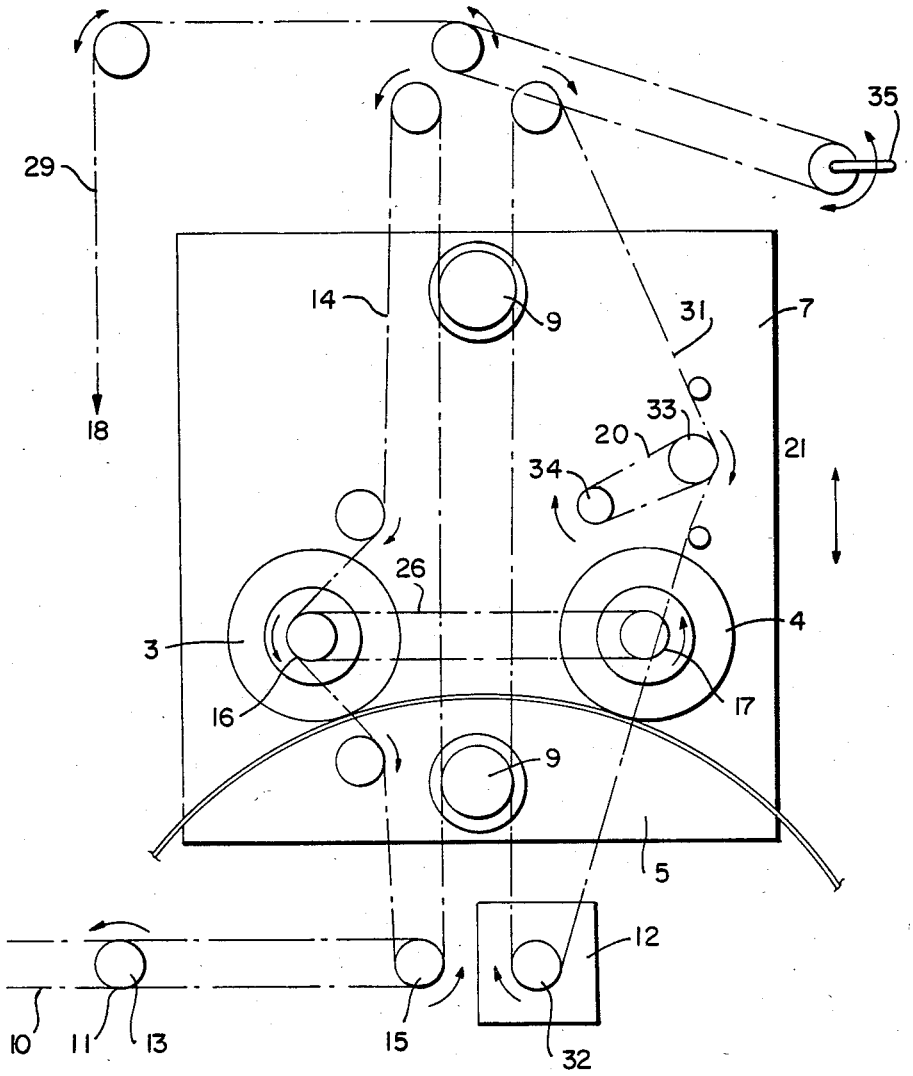
FIG. 4 is a schematic end view of the drive of the winding according to the invention.

Referring now to the drawings, the structure and the operation of the winder according to the invention is as follows, this winder being disposed either at the front or to the rear of a machine, for example a knitting machine (not shown).

As shown in the accompanying drawings, the knit 1 coming from the knitting machine is wound on a cylindrical support (mandrel) 2 which is driven by tangential contact with driving cylinders (or rollers) 3, 4.

According to the invention, the driving cylinders 3, 4 are at least two in number and are disposed above the winding 5 of material, symmetrically on either side of a vertical plane XX passing through the axis of rotation of the support mandrel 2. The driving cylinders 3, 4 are mounted on a chassis 6, via a roller-holder constituted by two support plates 7 mounted to slide freely on guiding uprights 8, disposed on each side of the machine on the chassis 6. The support plates 7 are guided on the uprights 8 by rollers 9. The driving cylinders 3, 4 are of course mounted on roller bearings.

The cylinders 3, 4 are driven in this embodiment via a chain 10 driven by the knitting machine, on gear train 11 (or gear box) acting on a control pin 13 allowing a symmetrical drive on each side. Transmission of the movement is obtained via a chain 14 which passes over gears 15, 16, 17 and guide elements. The gears 16, 17 are mounted on the support plates 7 and therefore move therewith.

Drive of the selvedge expander screw 21 and expander brush 22 is effected, in this example, via a chain 31 controlled by an electric motor 12 which passes over gears 33 and guide elements. Gears 32 and 33 are mounted on the support plates 7 and move therewith.

Futhermore, a system incorporating a counterweight is associated with the system for driving by cylinders so that the latter exert a constant pressure on the winding. This counterweight system is constituted, in the embodiment described, by an assembly 18 suspended in a housing 19 of the frame 6. It is connected, via belts or chains 29, to the support plates 7. It may extend over the whole width of the assembly or, as in the present example, simply on each side. The two counterweights are connected by a pin 36 allowing a parallel rise and descent of the plates.

The winder is also associated with means for expanding and unwinding the selvedges of the knit. These means are constituted by a conventional expander roller 21 comprising a surface of helicoidal section, inverted on each side and by a helicoidal rotary brush 22. Such an expander system is shown in greater detail in FIG. 3 and, thanks to the particular structure of the drive system, makes it possible to act on the knit in the immediate proximity of the expander roller. Rotation of the expander bar 21 and of the helicoidal brush 22 is obtained by the control chain 31 for the expander bar and via the chain 20 for the helicoidal brush.

As for the winding mandrel 2, it is supported in a container or carriage 25 capable of being displaced for example by means of a pallet truck. The ends of the roller 2 are mounted in appropriate bearings 39 provided on the sides of the carriage 25 beneath the roller bearing 30. As shown in FIG. 5, a second roller bearing 23 is also provided. This roller bearing 23 allows an exact parallelism between the cylinders 3 and 4 and the mandrel 2 for the whole duration of the winding. The roller bearing 30 allows the unwinding of the finished piece for example in front of a tenter. In this embodiment, the roller bearing 23 abuts on an appropriate bearing 24 provided on the chassis 6, the latter bearing being adjustable in height as a function of the desired diameter of the piece 5.

This system of winding operates as follows: the container 25 equipped with the winding mandrel 2 is brought below the driving cylinders 3, 4. The knit 1 leaving the knitting machine is conducted in the manner shown in FIG. 1, passing around the expander system 21 and enveloping one of the driving cylinders, cylinder 4 in the present case. The counterweight system 18 was previously adjusted as a function of the pressure which it is desired to ensure on the knit. During production of the knit, the winding 5 increases in diameter and, simultaneously, the cylinders 3, 4 on the plates 7 move vertically along the guide 8. At the end of operation, the piece 5 is released from the cylinders 3 and 4 by the lifting crank 35 connected to the pin 36 of the counterweight chains 29. The finished piece of knit remains in its container 25 (or on its carriage), is evacuated for example by means of a pallet truck and the container or carriage is placed for the winding of the following piece.

Such a system of winding makes it possible to form reels of a very considerable weight, the diameter of the reel easily being able to attain 1 to 1.7 m, i.e. to have a weight of material which may attain several hundreds of kilos. Such a winding capacity is possible, in the present case, by the fact that the pressure exerted by the driving cylinders 3, 4 remains constant and may be pre-adjusted beforehand by means of the counterweights 18. Moreover, thanks to such a system, it is possible to reduce the forces of traction, the speed of winding being able to be very slow. It is therefore possible to obtain a greater relaxation of the knit. Finally, such a system may easily be equipped with expander means and with brushes which act on the edge of the lap of knit just before it passes over the driving cylinder 4.

A winder of this type may be of any width as a function of the width of the knit. Finally, the winding being independent of the weight of the piece, the diameter of wound fabric may, as mentioned hereinabove, be considerably increased.

The invention is, of course, not limited to the embodiment described hereibefore, but covers all the embodiments thereof made in the same spirit.

For example, if in the embodiment described hereinabove the driving cylinders are only two in number, it may be envisaged, without departing from the scope of the invention, to provide additional driving cylinders 37 and 38 shown in broken lines in FIG. 1, which abut on the winding of fabric formed only from a certain diameter of said winding. The weight of these additional driving cylinders is, of course, also compensated by the counterweight system.

What is claimed is:

1. A device for winding a fabric during different stages of its manufacture in a fabric manufacturing machine driven by a motor, said device comprising:
   - a chassis including opposed uprights and a roller-holder mounted for vertical sliding movement on the uprights,
   - a support arranged between the uprights of said chassis,
   - a support mandrel rotatably mounted in the support, said support mandrel rotating about an axis to wind said fabric to form a winding of increasing diameter, the uprights of said chassis being located at axial ends of said support mandrel; and at least two drive cylinders having means for rotating the drive cylinders at the same speed to drive said support mandrel, said drive cylinders disposed above said support mandrel in tangential contact with said winding and supported by the roller-holder mounted for vertical sliding movement on the uprights to exert a constant pressure on the winding, said drive cylinders being disposed symmetrically on each side of a vertical plane passing through said axis and moving vertically upward as the diameter of said winding increases.

2. The device of claim 1, wherein said support for said mandrel is a carriage selectively disengagable from said chassis to transport and store said winding.

3. The device of claim 2, wherein said carriage includes sidewalls for supporting adjacent carriages in a stacked array.

4. The device of claim 2, wherein first bearings are provided for mounting the axial ends of the support mandrel in the carriage, and second bearings are provided for supporting the axial ends of said support mandrel on said chassis, said second bearings mantaining parallelism between said driving cylinders and said support mandrel while said fabric is wound on said support mandrel.

5. The device of claim 1, wherein said means for rotating the drive cylinders is another motor independent from the motor driving said machine.

6. The device of claim 1, wherein said means for rotating the drive cylinders is the motor for driving said machine.

7. The device of claim 1 further comprising means for unwinding selvedges in the fabric.

8. The device of claim 7 wherein said means for unwinding includes a rotating brush and an expander bar disposed adjacent one of the driving cylinders.

9. The device of claim 1 further comprising counterweight means associated with said driving cylinders for causing said drive cylinders to exert constant pressure on the winding.

10. A device for winding a fabric during different stages of its manufacture, said device comprising:

a chassis including opposed uprights and a roller-holder mounted for vertical sliding movement on the uprights, a support arranged between the uprights of said chassis, a support mandrel rotatably mounted on the support, said support mandrel rotating about an axis to wind said fabric to form a winding of increasing diameter, the uprights of said chassis being located at axial ends of said support mandrel;

at least two drive cylinders having means for rotating the drive cylinders at the same speed to drive the support mandrel, said drive cylinders disposed above the support mandrel in tangential contact with said winding, said drive cylinders being supported by the roller-holder mounted for vertical sliding movement on the uprights located at axial ends of the support mandrel, said drive cylinders being disposed symmetrically on either side of a vertical plane passing through said axis and moving vertically upward as the diameter of said winding increases; and counterweight means associated with said driving cylinders for causing said driving cylinders to exert constant pressure on the winding.

* * * * *